US005501086A

United States Patent [19]

Sherlock

[11] Patent Number: 5,501,086

[45] Date of Patent: Mar. 26, 1996

[54] SECURITY DEVICE

[76] Inventor: Thomas M. Sherlock, 27260 Sherlock Rd., Los Altos Hills, Calif. 94022

[21] Appl. No.: 257,504

[22] Filed: Jun. 8, 1994

[51] Int. Cl.[6] ..... E05B 73/00

[52] U.S. Cl. ..... 70/58; 70/14; 248/530; 248/551; 52/155; 52/157

[58] Field of Search ..... 70/14, 18, 19, 70/57, 58, 63, 32, 34; 109/45, 50–52; 248/156, 530, 532, 545, 551–553; 52/155, 157, 165, 166

[56] References Cited

U.S. PATENT DOCUMENTS

| | | | |
|---|---|---|---|
| 501,811 | 7/1893 | Stombaugh | 52/157 |
| 1,283,246 | 10/1918 | Maloney | 52/157 |
| 1,308,939 | 7/1919 | Eggleston | 52/155 |
| 3,736,711 | 6/1973 | Thornbrugh | 52/157 X |
| 3,797,283 | 3/1974 | Honer | 70/58 |
| 4,118,902 | 10/1978 | Saxton | 70/58 X |
| 4,302,955 | 12/1981 | Kawakami | 70/30 |
| 4,562,707 | 1/1986 | Graham, III | 70/58 |
| 4,867,478 | 9/1989 | Anderson | 70/30 X |
| 4,907,522 | 3/1990 | Lutzke | 70/57 X |
| 5,139,235 | 8/1992 | Kilmer | 52/157 X |

FOREIGN PATENT DOCUMENTS

| | | | |
|---|---|---|---|
| 517809 | 5/1921 | France | 52/155 |
| 80147 | 3/1894 | Germany | 52/157 |
| 865044 | 4/1961 | United Kingdom | 52/157 |

*Primary Examiner*—Steven N. Meyers
*Assistant Examiner*—Suzanne L. Dino
*Attorney, Agent, or Firm*—Roy W. Latham

[57] ABSTRACT

A security device for personal property at a beach includes two rods of a particular construction to permit ready mounting in loose soil or sand. A bar is formed to be attached readily between the two rods, so that neither rod can be turned to remove. A chain is secured at one end of the bar which prevents removal of the bar, and a padlock secures the chain to an item to be protected.

1 Claim, 5 Drawing Sheets

SECURITY DEVICE

BACKGROUND OF THE INVENTION

This invention, generally, relates to devices for securing items of personal property in open areas having little or nothing to which to fasten such items and, more particularly, to a portable device for securing items to the ground easily, conveniently and securely.

Theft of personal property is a perennial problem. However, short of standing guard or using a costly alarm system, little effort has been devoted to solving this problem. The common alternative is simply to keep items of personal property locked up.

To secure an item with a lock, there must be a way to attach the item to a fixture. Such a fixture is something too large, too heavy, or too well-planted to be moved. For example, a suitable fixture might be a portion of a building like a floor or wall, a heavy safe or, outdoors, it might be a utility pole or tree.

A determined thief with the right tools and enough time can defeat most security devices. However, if defeating a security device poses a clear time-consuming situation to a thief, the thief will be deterred—even if just to seek easier prey elsewhere. The conclusion, therefore, is to secure items as well as possible.

A particularly troublesome type of theft is the theft of personal property from individuals at the beach because they cannot keep possessions with them while engaged in customary beach type of recreational activities. An alarm system is not likely to be effective by itself because even if the owner heard an alarm, the thief would likely escape with the items of personal property anyway by simply mingling with the beach crowd.

The type of device that is needed, which is the most effective against beach theft, is one that requires a maximum amount of time and effort to defeat because the class of thieves involved is likely to be deterred by the prospect of having to spend time stealing in a public place. Few beaches offer areas for securing items of personal property, and generally, having fixed objects at a beach to which they can be secured is inconsistent with the recreational usage. Therefore, individuals at a beach are unusually vulnerable to theft.

OBJECTS AND SUMMARY OF THE INVENTION

Accordingly, it is an object of the invention to provide a security device for use on open ground areas to secure personal property.

It is also an object of the invention to provide a portable and low cost security device for securing property on a beach.

It is another object of the invention to provide a security device that can be installed and removed readily.

Further objects of the invention will become apparent from the following detailed description.

Briefly, a security device that is constructed and arranged according to the present invention has a flexible member, such as a chain or a thin cable, with a loop on one end and a padlock to attach the loop to a personal property item. Two elongated rods are formed for threading into the ground, and a bridge bar provides an attachment for securing the opposite end of the flexible member securely in a desired location on the ground.

More particularly, each of the elongated rods has a blade formed at one end and a loop formed at the opposite end to receive the bridge bar for threading the blade end into the ground and through which the bridge bar is inserted to complete the device, as will be described presently.

DETAILED DESCRIPTION OF THE INVENTION

Figure 1:
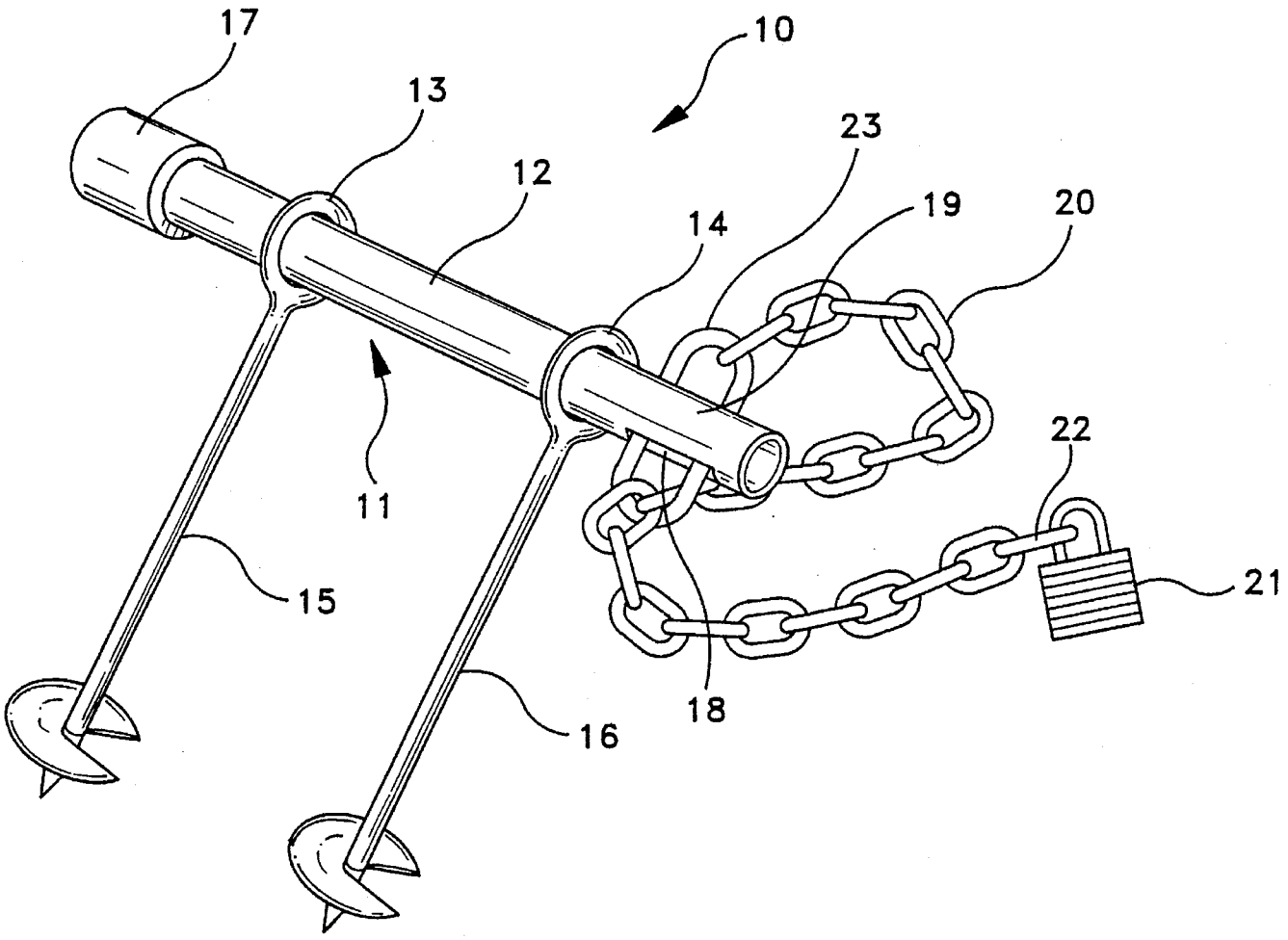
FIG. 1 is an illustration of the security device constructed and arranged in accordance with the present invention.

Referring to FIG. 1, a security device constructed according to the present invention is identified generally by the reference numeral 10. A bridge bar 11 has a body 12 formed to fit readily through loops 13 and 14 in one end of each of two rods 15 and 16, respectively, so neither rod can be removed after installed, as will be described.

A cap 17 is affixed firmly to an end of the bridge bar 11 so that it cannot be removed easily. The body 12 of the bridge bar 11 has an outside diameter smaller than the inside diameter of either loop 13 or 14. An opening 18 is formed in the opposite end 19 of the bridge bar 11 to receive a link of a chain 20.

A padlock 21 is attached to one end 22 of the chain 20, and the other end of the chain 20 has an elongated end link 23 to fit through the opening 18, which is a slotted opening in this form of the invention. The end link 23 protrudes from the opening 18, where it receives the chain 20, as shown in FIG. 1 of the drawings. The padlock 21 is used to attach the chain 20 of the security device 10 to an item of personal property, which will be described in more detail as the description proceeds.

Figure 2:
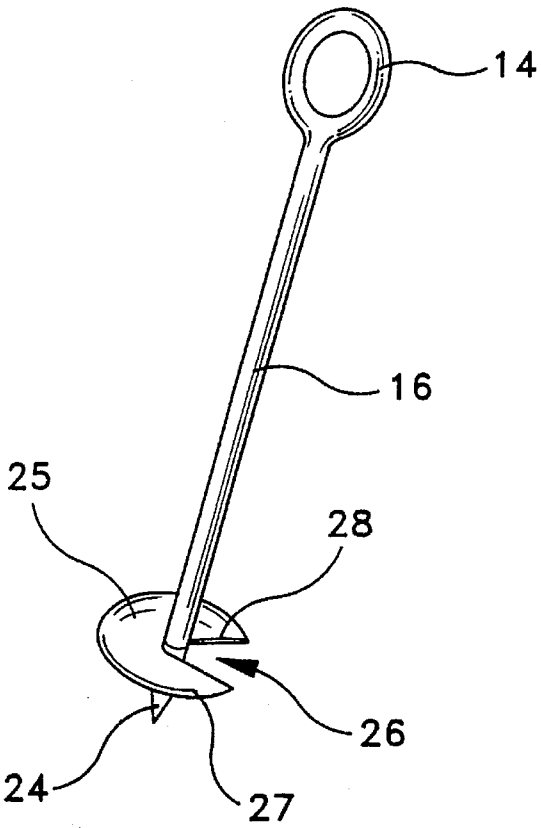
FIG. 2 is an illustration of component parts that form one of the rods constructed according to the invention.

Now referring to FIG. 2 of the drawings, the rod 16 is shown in more detail as having its lower end 24 chisel-shaped for more effective penetration in the ground than a point or other symmetrically shaped end. Also visible in this view is the loop being formed integrally with the rod 16 to provide a maximum of strength.

A single spiral blade 25 is fixedly attached at the other end of the rod 16. The rod 16, typically, is made of steel to provide a still further increase in strength. In the presently preferred embodiment, the rods 15 and 16 both are 30 inches from end to end with each of the blades being three inches in diameter.

The diameter of the loop 14 accommodates the bridge bar 12, FIG. 1, and typically, the loop 14 is one inch in diameter. The blade 25 preferably is circular in configuration and has a notch 26 to form edges 27 and 28. The edge 27 is slightly lower than the edge 28 and is sharper to ease its cutting action when rotated in a counterclockwise direction.

Figure 3:
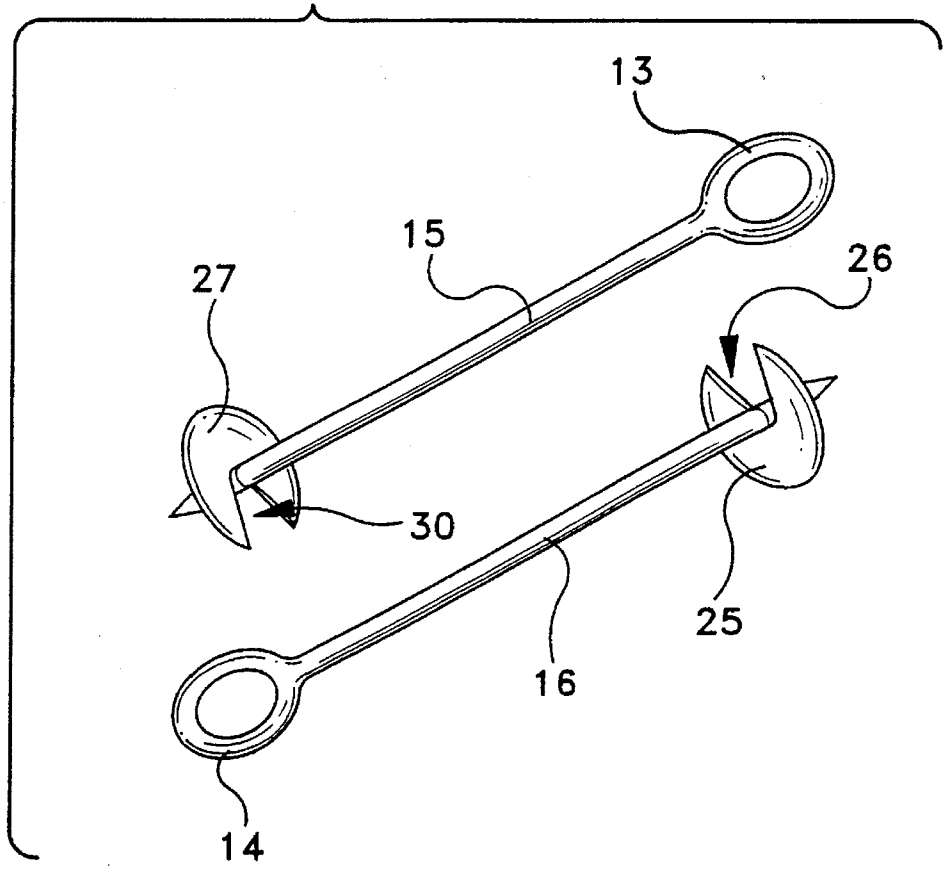
FIG. 3 is an illustration of two of the rods of the invention arranged to permit storage to save space when not in use.

More details for the rods 15 and 16 are shown in FIG. 3. By positioning the rods 15 and 16 as shown, two such rods can be stored together to save storage space. To fit together, the blades 25 and 29 have gaps 26 and 30, respectively.

For storage and transport, one rod is inserted in the gap of the blade on the other rod.

Figure 4:
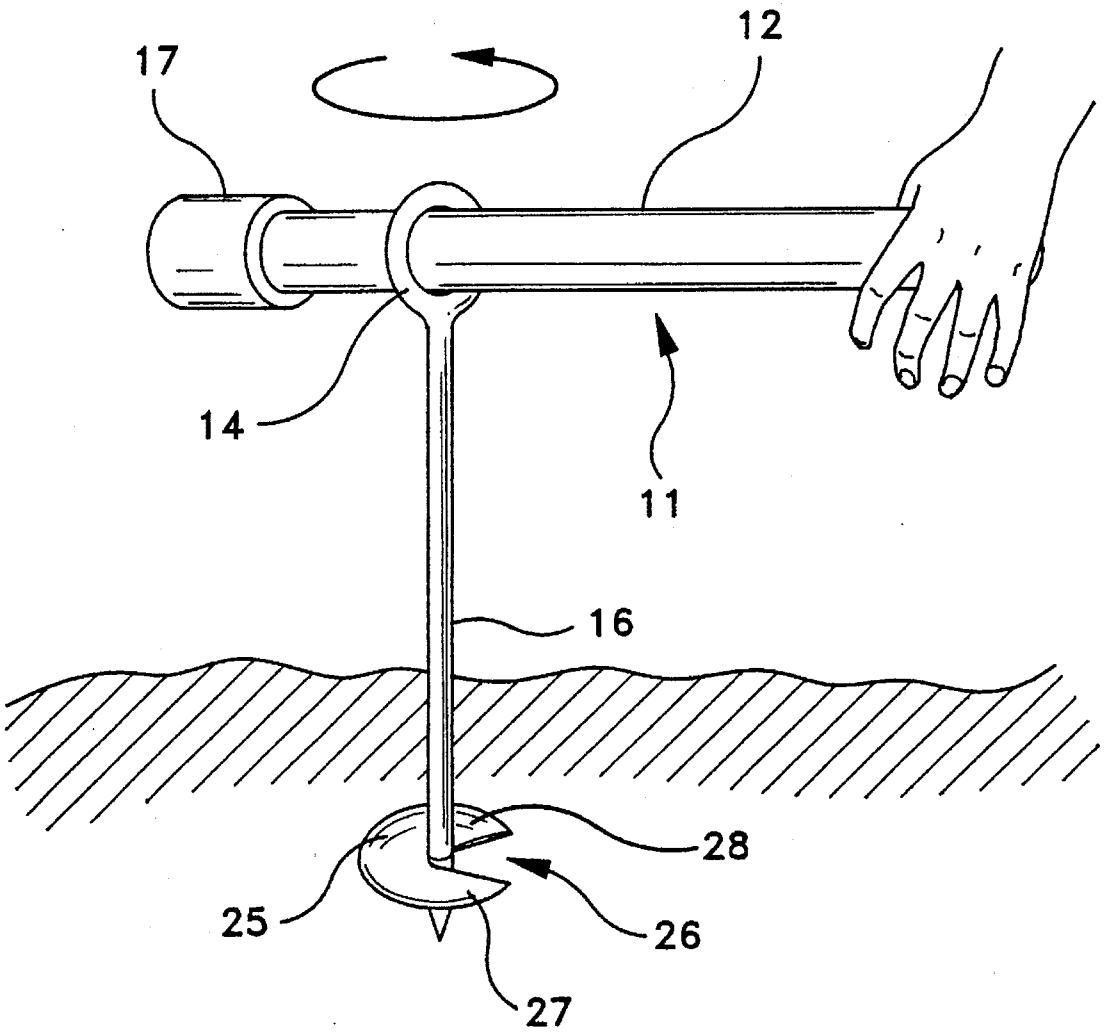
FIG. 4 is an illustration of the bridge bar being used to install one of the rods into the ground.

Referring next to FIG. 4, to use the security device 10, the first step is to thread a rod into the ground, which can be soil or sand. This is facilitated by inserting the bridge bar 11 through a loop and using the bridge bar body 12 as a handle, rotating the rod in a counterclockwise direction, whereby the single blade 25 threads the rod into the ground.

A user will grasp both ends of the bridge bar 11 in order to achieve a balance in the mechanical forces in harder or more packed soil. Of course, it will be much easier in loose sand, in which case a user would insert the bridge bar 11 half way through the loop and grasp one end with one hand and the other end with the other hand.

Each of the rods will be threaded into the ground until about six inches of the rod is left above the surface. Of course, in firmer soil, more of the rod can be left above the ground surface.

Figure 5:
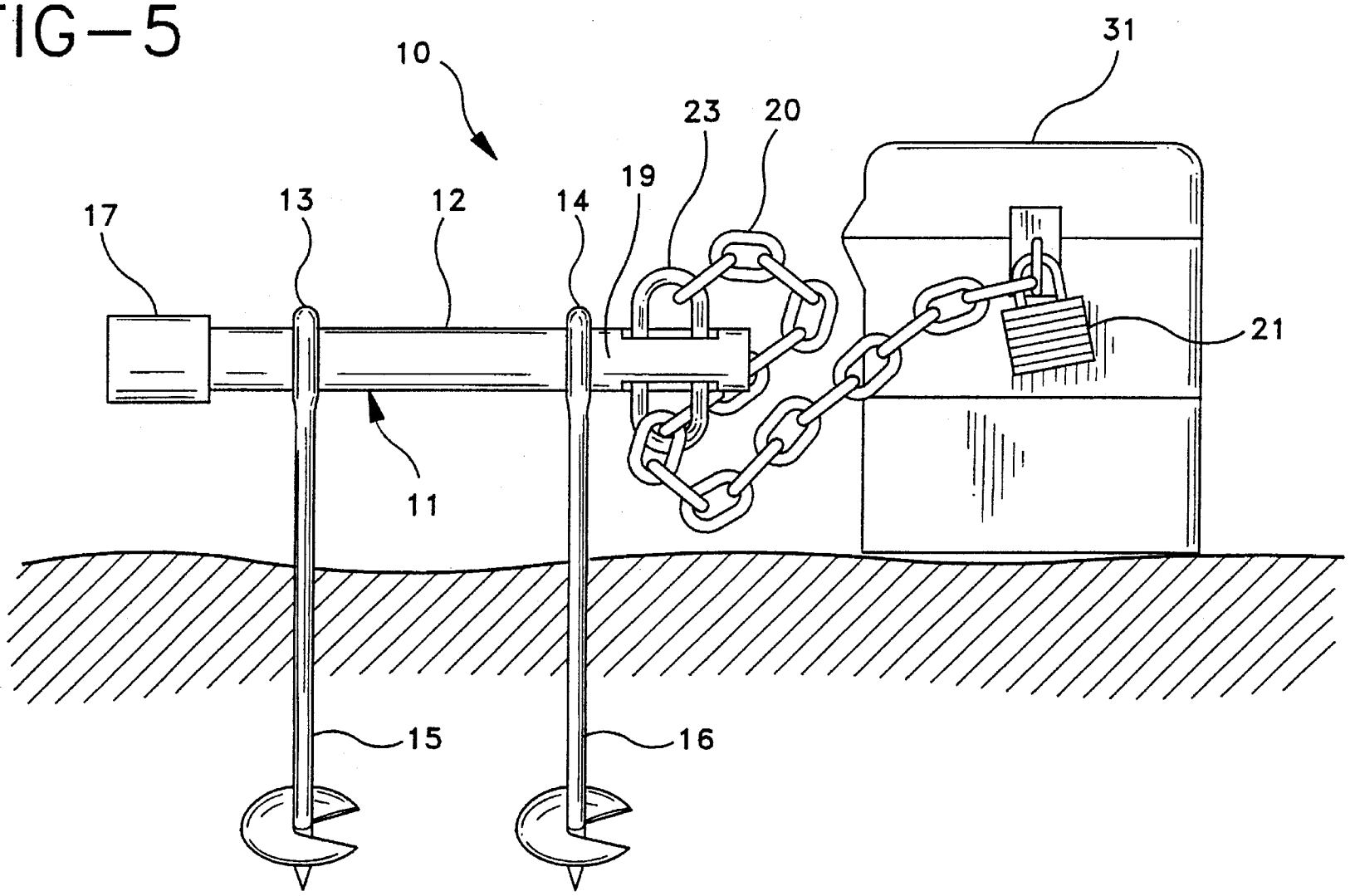
FIG. 5 is an illustration showing the security device of the invention with an item of personal property attached.

FIG. 5 illustrates the security device 10 of the invention after installation is complete. This view shows that the two rods are spaced closer than the length of the bridge bar 11.

Then, the end link 23 of the chain 20 is inserted into the opening 18 in the bridge bar 11. The end link 23 protrudes through the opening 18 and the chain 20 is passed through the protruding portion of the end link 23.

Finally, an item 31 of personal property to be secured is attached to the end of the chain 20 using the padlock 21. When installed as described, the bridge bar 11 prevents either of the rods from being unscrewed.

To defeat the security device 10 of the invention, as described hereinabove, the rods would have to be uprooted, which requires substantial force, or the rods would have to be dug out, which requires substantial time. Tests of a prototype device confirmed that the security device 10 offers a significant deterrent to theft when installed as described.

Attempting to dig out the device 10 from sand is difficult because the sad tends to flow into a narrow hole. Consequently, a large, time consuming excavation must be made.

Figure 6:
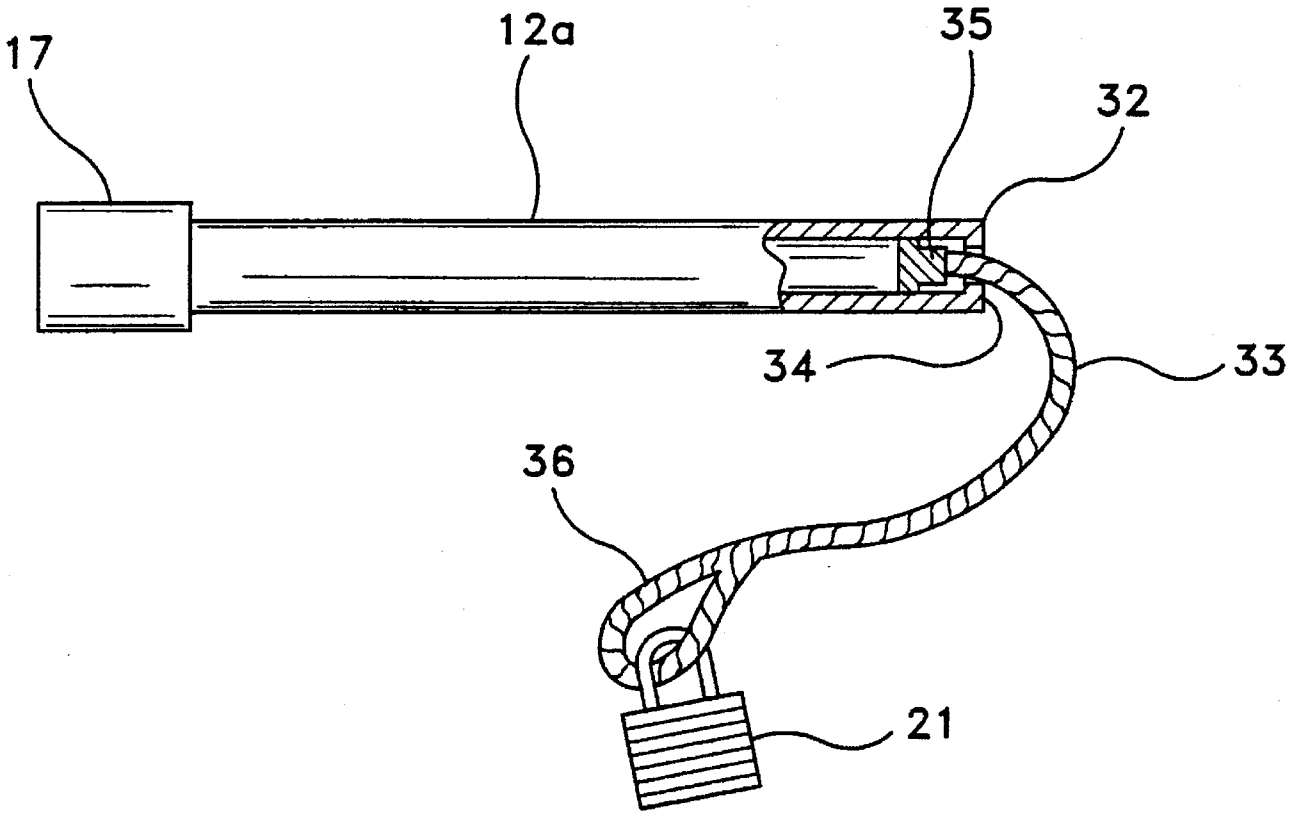
FIG. 6 is an illustration of a modification for the bridge bar with a modified form of the flexible member attached.

Modifications of the security device 10 are possible within the scope of the invention. For example, as shown in FIG. 6, a modified bridge bar 12A is formed with a hollow, tubular steel body having an integral partial closure 32 at the end opposite the cap 17. A thin, steel cable 33 is passed through a hole 34 in the partial closure 32.

The cable 33 is prevented from being removed through the hole 34 by permanently attaching a stop 35 to the cable end within the bridge bar 12A. The free end of the cable 33 has a woven loop 36 to which the padlock 21 is attached.

An advantage of this modified bridge bar is that the cable 33 is permanently attached to the bar and may be at least partially stored within the bar. If the bridge bar 12A is pulled out of the loops on the rods, the rods might be partially unscrewed, but the cable twists up and prevents unscrewing beyond a few turns.

A further modification to which the present invention is capable of effective use is in combination with other deterrents to theft. For example, a lockable compartment can be added to the bottom of an ice chest to enclose extra weight, such as a quantity of sand or other material that may be available at the use site.

It should be understood that the foregoing description is only illustrative of a preferred embodiment of the invention. Various additional modifications can be devised by those skilled in the art without departing from the spirit and scope of the invention which is defined by the appended claims.

What is claimed is:

1. A device for securing an item to loose ground, such as sand at a beach, comprising:

two rods each with first and second ends, each of said rods having a length of about 30 inches, each of said rods having at least one substantially circular blade with a diameter of about 3 inches at said first end for threading into the ground by rotating;

said substantially circular blade having a portion cut to provide a cutting edge for said threading, and each of said rods having an opening at said second end;

a bar having a configuration to fit said opening at said second end in each of said rods, and having a predetermined length;

said bar having first and second ends, a elongated slot at said second end for attaching a first end of a flexible member, and means at said first end of said bar defining a configuration for preventing said first end of said bar from going through said opening at said second end in both of said rods;

said flexible member being in the form of a chain having first and second ends, said chain having links of a predetermined configuration with the link at said first end being elongated to fit through said elongated slot at said second end of said bar sufficiently to receive said second end of said chain and the other links readily therethrough; and means for securing a second end of said chain to said item to be secured;

whereby said two rods are threaded into said ground spaced apart a distance less than said predetermined length of said bar so that with said bar installed between said two rods, neither of said two rods can be unthreaded from said ground.

* * * * *